US006390079B1

(12) United States Patent
Gagnon et al.

(10) Patent No.: US 6,390,079 B1
(45) Date of Patent: May 21, 2002

(54) EXHAUST GAS RECIRCULATION VALVE INCLUDING CAM LINKAGE FOR CONVERTING CONSTANT ANGULAR MOTION TO NON-LINEAR MOTION

(75) Inventors: Frederic Gagnon; Kwang Yew, both of Chatham (CA)

(73) Assignee: Siemens Canada Limited (CA)

( * ) Notice: Subject to any disclaimer, the term of this patent is extended or adjusted under 35 U.S.C. 154(b) by 0 days.

(21) Appl. No.: 09/642,473

(22) Filed: Aug. 21, 2000

(51) Int. Cl.[7] ..... F02M 25/07
(52) U.S. Cl. ..... 123/568.23
(58) Field of Search ..... 123/568.11, 568.19, 123/568.23, 568.24

(56) References Cited

U.S. PATENT DOCUMENTS

| | | | | | |
|---|---|---|---|---|---|
| 3,807,374 A | | 4/1974 | Marsee | 123/568.29 |
| 3,981,284 A | * | 9/1976 | Gospodar | 123/568.23 |
| 4,094,285 A | * | 6/1978 | Oyama et al. | 123/568.23 |
| 4,561,408 A | * | 12/1985 | Jenkins | 123/568.23 |
| 4,690,119 A | * | 9/1987 | Makino et al. | 123/568.23 |
| 5,213,087 A | * | 5/1993 | Sausner et al. | 123/568.19 |
| 6,039,034 A | * | 3/2000 | Field et al. | 123/568.23 |

FOREIGN PATENT DOCUMENTS

| | | |
|---|---|---|
| EP | 0 533 546 | 3/1993 |
| EP | 0 856 657 A2 | 8/1998 |
| EP | 0 856 657 A3 | 12/1998 |
| EP | 1 041 269 | 10/2000 |
| JP | 04244686 | 9/1992 |

* cited by examiner

*Primary Examiner*—Willis R. Wolfe

(57) ABSTRACT

Disclosed is a exhaust gas recirculation valve including a motor turning a shaft, a cam disposed on the shaft, the cam having a profile, and a valve assembly including a seat and a pintle. The pintle is disposed for reciprocal movement with respect to the valve for permitting and prohibiting delivery of exhaust gas through the valve assembly. The pintle is also in contact with the profile of the cam such that constant angular motion of the torque output shaft is converted to non-linear motion of the pintle.

8 Claims, 2 Drawing Sheets

EXHAUST GAS RECIRCULATION VALVE INCLUDING CAM LINKAGE FOR CONVERTING CONSTANT ANGULAR MOTION TO NON-LINEAR MOTION

BACKGROUND OF THE INVENTION

The present invention relates to an improved exhaust gas recirculation (EGR) valve, and more particularly to an EGR valve including an electric actuator that converts rotary motion to linear motion.

Various systems have been developed to reduce the emission of undesirable combustion products, such as nitrogen oxides (NOX), from internal combustion engines. One such system is the EGR system. In EGR systems, a portion of the engine exhaust is recirculated into the intake manifold where it mixes with incoming air. The mixture of the exhaust gases with the air-fuel mixture in the engine cylinders provides lower peak temperatures during combustion, resulting in a reduction in the quantity of NOX produced.

Conventional EGR systems utilize an EGR valve to regulate the flow of exhaust gases from an internal combustion engine back into the intake manifold of the engine. The EGR valves in these conventional systems are known to be vacuum-operated (i.e., using intake manifold vacuum as a power supply for operating the valve) or electrically-operated (i.e., using an electric solenoid). EGR valves are also known that use an electric vacuum regulator (EVR) to control the supply of intake manifold vacuum to a conventional vacuum-operated EGR valve.

A disadvantage of known electrically operated EGR valves is that exhaust gas flow is related to the characteristics (speed, displacement, etc.) of the electric operator. However, it is desirable to control the exhaust gas flow without costly and complex electronics for customizing the characteristics of the electric operator.

SUMMARY OF THE INVENTION

The present invention provides a valve including a motor having a torque output shaft, a cam disposed on the torque output shaft, the cam having a profile, and a valve assembly including a valve and a pintle. The pintle is disposed in the valve and adapted to permit and prohibit delivery of exhaust gas from the valve. The pintle is also in contact with the profile of the cam such that constant rotary motion of the torque output shaft is converted to linear motion of the pintle having a variable acceleration.

The present invention further provides a valve including a motor having a torque output shaft, a cam disposed on the torque output shaft, and a valve assembly including a valve, a pintle, and a contact. The pintle is disposed in the valve and adapted to permit and prohibit delivery of exhaust gas from the valve. The contact is disposed at an end of the pintle and directly contacting the cam with the pintle. One of the cam and the contact has a profile such that constant rotary motion of the torque output shaft is converted to linear motion of the pintle having a variable acceleration.

BRIEF DESCRIPTION OF THE DRAWINGS

The accompanying drawings, which are incorporated herein and constitute part of this specification, illustrate an embodiment of the invention, and, together with the general description given above and the detailed description given below, serve to explain features of the invention.

DETAILED DESCRIPTION OF THE PREFERRED EMBODIMENTS

Figure 1:
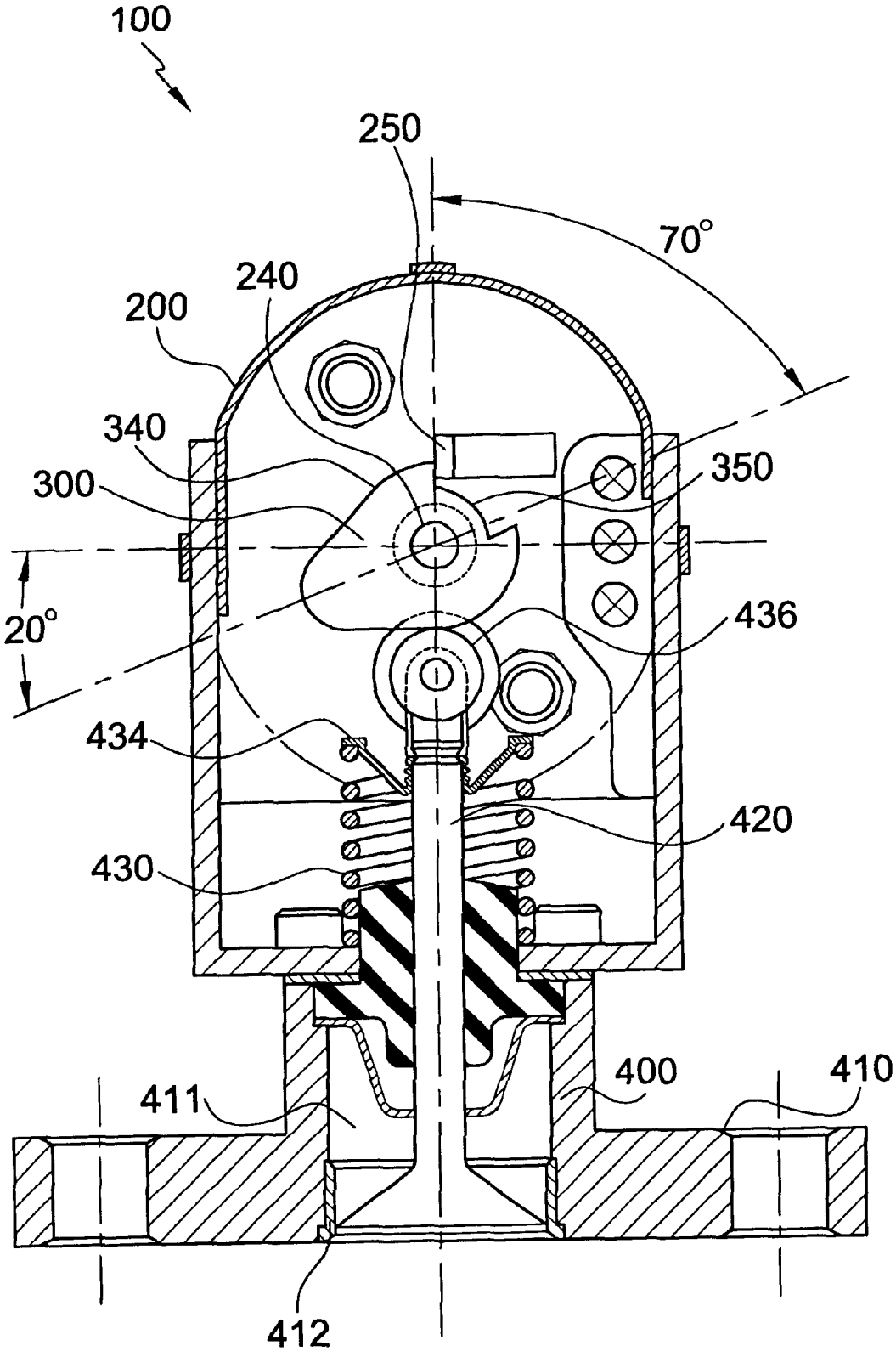
FIG. 1 shows a side view of an example of the exhaust gas recirculation valve of the present invention.
Figure 2:
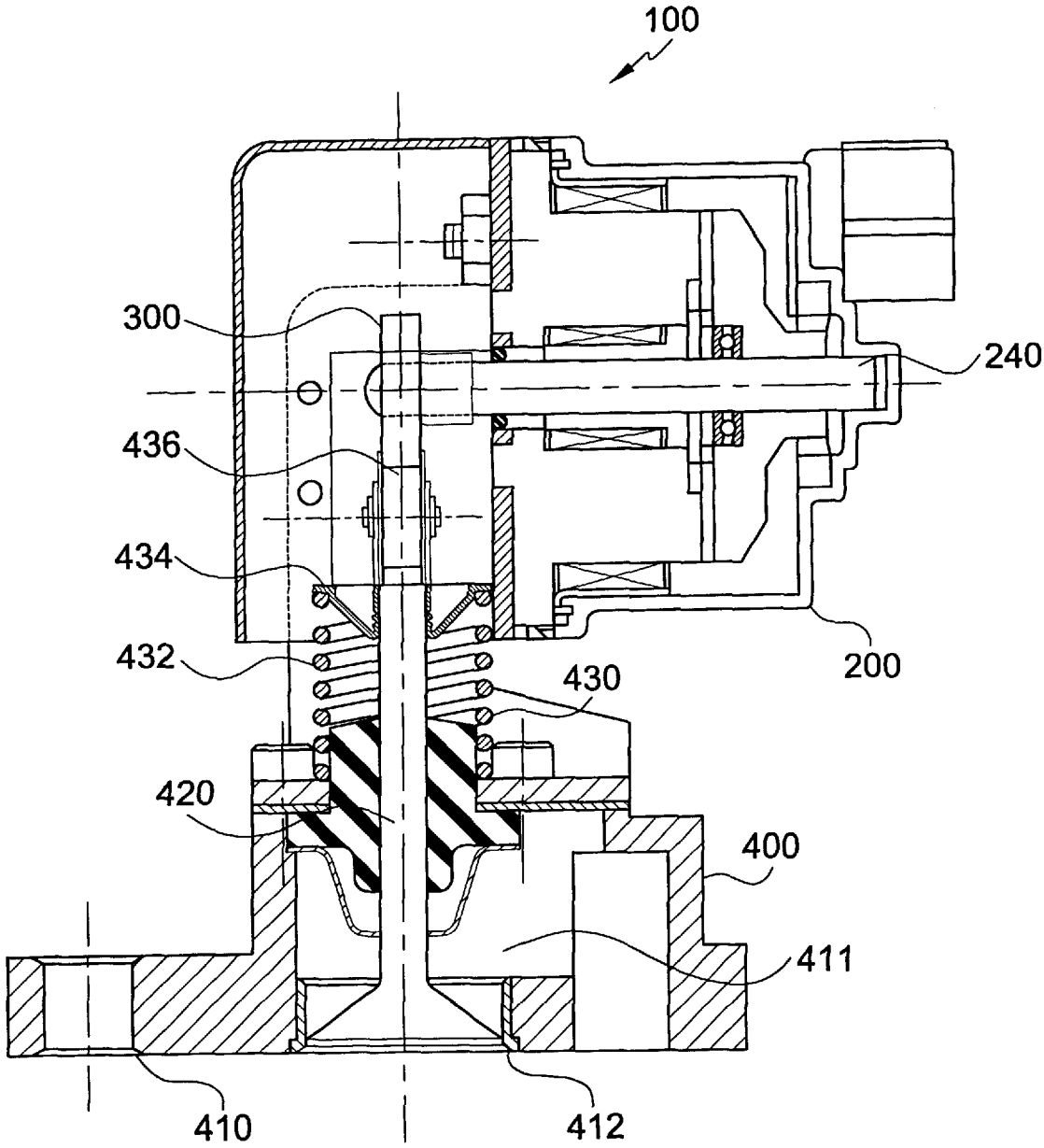
FIG. 2 shows a front view of the example of the exhaust gas recirculation valve of FIG. 1.

The drawings figures illustrate an exhaust gas recirculation (EGR) valve for an internal combustion engine (not shown). The EGR valve 100 includes a motor 200, a cam link 300, and a valve assembly 400. The EGR valve 100 uses the cam link 300 to convert substantially constant angular motion of the motor 200 to reciprocating motion of the valve assembly 400. The reciprocating motion can be non-linear, i.e., the speed at which the valve assembly 400 operates can vary with respect to displacement of the valve assembly 400.

The motor 200 can be of a reversible motor of any known type. The motor 200 includes a shaft 240 that provides angular motion and output torque. The motor 200 can include a sensor 250 to detect the angular position of the shaft 240. The sensor 250 can be connected to an electrical circuit for reversing the direction of rotation of the motor 200 or prohibiting further operation of the motor 200 (e.g., turn off the motor 200).

The cam link 300 is disposed on the shaft 240 for rotation therewith. The cam link 300 can be secured or fastened to the shaft 240 by any of a variety of conventional techniques, including welding or bolting. The cam link 300 includes an outer profile 340 that can be non-circular, as illustrated in FIG. 1. The non-circular outer profile 340 can include a varying radius of curvature relative to the axis of rotation of the shaft 240. It is understood that the non-circular outer cam profile 340 can be used to convert constant angular motion to non-linear displacement reciprocating motion. The cam link 300 can also include a sensor area 350. The sensor area 350 can be used in conjunction with the sensor 250 to indicate when the shaft 240 and the cam link 300 are at a particular angular position. As shown in FIG. 1, the sensor area 350 can be approximately 70 degrees.

The valve assembly 400 includes a seat 410, a pintle 420, and a spring retainer assembly 430. The seat 410 includes a passage 411 and a mouth 412. Both the passage 411 and the mouth 412 deliver exhaust gas generated during the operation of a the internal combustion engine (not shown) in a known manner, as discussed above. The pintle 420 includes a portion adapted to occlude the mouth 412 of the seat 410. The pintle 420 can be of a conventional design and is positionable with respect to the mouth 412 in a known manner to permit or to prohibit the delivery of exhaust gas through the seat 410. Is it further understood that the largest flow volume of exhaust gas can be delivered through the valve 400 when the pintle 420 is displaced a maximum distance from the mouth 412.

The non-linear travel of the pintle 420 also provides a high force at the opening of the valve assembly 400, which is advantageous for breaking ice or opening the valve assembly 400 against high vacuum levels in the intake manifold (not shown).

A spring assembly 430 includes a spring 432 and an adjustable retainer 434. The spring 432, which can be a coil spring surrounding the pintle 420, biases the pintle 420 to a closed position with respect to the mouth 412. The retainer 434 is adjustably located along a length of the pintle 420 before being fixed thereto, e.g., by cincturing or crimping. By this arrangement, the spring biases the retainer 434 and the pintle 420 with respect to the seat 410.

The adjustment retainer 434 includes a cam follower 436. Although the cam follower 436 is shown in the figures as a separate, rotatable element, it is to be understood that the cam follower 436 can be a portion of the retainer 434 or a portion of the pintle 420. Thus, angular motion of the shaft 240 and the cam link 300 causes linear motion of the cam contact 436 and the pintle 420, i.e., to be reciprocated along the axis of the pintle 420.

During assembly of the EGR valve 100, the spring retainer assembly 430 can be adjusted such that the pintle 420 can prohibit the delivery of exhaust gas through the valve 400 when the cam link 300 is at a first position. The first position can correspond to a relative position between the sensor 250 of the motor 200 and the sensor area 350 of the cam link 300. As shown in the figures, the sensor 250 can indicate a boundary of the sensor area 350 when the pintle 420 contacts the mouth 412 of the valve 400. An angle between horizontal and an axis of symmetry of the cam link 300 can be 20 degrees when the cam link 300 is in the first position. The spring retainer assembly 430 can then be crimped onto the pintle 420 to secure its location.

During operation of the EGR valve, it is understood that the outer profile 340 of the cam link 300 can be shaped such that the angular motion of the shaft 240 causes non-linear displacement motion of the pintle 420.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A valve for regulating delivery of exhaust gas from an internal combustion engine to an intake manifold of the engine, the valve comprising:

a shaft oscillatable on an axis between first and second angular positions;

a sensor detecting the first and second angular positions of the shaft;

a cam fixed to the shaft and having a profile; and a valve including a seat and a pintle, the pintle being reciprocally mounted with respect to the seat to permit and prohibit delivery of exhaust gas to the intake manifold, wherein constant angular motion of the shaft is converted by operative engagement between the profile and the pintle to non-linear reciprocating motion of the pintle.

2. The valve according to claim 1, wherein the profile includes a first portion having a first radius of curvature and a second portion including a second radius of curvature different than the first radius of curvature.

3. The valve according to claim 1, wherein the cam includes a third portion actuating the sensor at the first and second angular positions of the shaft.

4. The valve according to claim 3, further comprising:

a motor turning the shaft between the first and second angular positions; and wherein actuating the sensor reverses the motor turning direction.

5. The valve according to claim 3, wherein the third portion comprises an arc of about 70 degrees around the axis.

6. The valve according to claim 1, further comprising:

a spring assembly biasing the pintle with respect to the seat to prohibit delivery of exhaust gas, the spring assembly including a spring and an adjuster fixed with respect to the pintle.

7. The valve according to claim 6, wherein the spring assembly includes a cam follower operatively engaging the profile such that constant angular motion of the shaft is converted to non-linear reciprocating motion of the pintle.

8. The valve according to claim 7, wherein the cam follower is rotatably with respect to the spring retainer.

* * * * *